United States Patent [19]

Beaupré et al.

[11] Patent Number: 4,470,876

[45] Date of Patent: Sep. 11, 1984

[54] KRAFT OVERLOAD RECOVERY PROCESS

[76] Inventors: Marc F. Beaupré, R.R. 2, Ayer's Cliff, Quebec, Canada, J0B 1C0; Emile A. Cambron, Hudson, Canada, J0P 1H0; Emily T. Cambron, P.O. Box 471, Hudson, P.Q., J0P 1H0, Canada, heir of said Emile Cambron, deceased

[21] Appl. No.: 400,960

[22] Filed: Jul. 22, 1982

[51] Int. Cl.[3] ..... D21C 11/12

[52] U.S. Cl. ..... 162/16; 162/30.1; 162/30.11

[58] Field of Search ..... 162/16, 30.1, 30.11

[56] References Cited

U.S. PATENT DOCUMENTS 4,011,129 3/1977 Tomlinson ..... 192/30.11

FOREIGN PATENT DOCUMENTS 650912 10/1962 Canada ..... 162/16

821621 4/1981 U.S.S.R. ..... 162/16

*Primary Examiner*—William Smith

[57] ABSTRACT

The present invention relates to a kraft overload recovery process for the treatment of kraft black liquor (b.l.) which comprises acidifying the b.l. with an acid comprising sulfuric acid, separating the lignin therefrom, and further treating the residual b.l. for recovery of inorganics contained therein for use as a source of cooking chemical in kraft cooks.

16 Claims, 1 Drawing Figure

KRAFT OVERLOAD RECOVERY PROCESS

FIELD OF THE INVENTION

The present invention relates to a process for the treatment of kraft black liquor. More particularly the present invention relates to a process for the treatment of black liquor which can augment the saltcake recovery capacity of a recovery installation.

BACKGROUND OF THE INVENTION/PRIOR ART

The kraft pulping of lignocellulosic material in the form of wood chips usually entails the reaction and dissolution by an alkaline liquor (white liquor) of lignin which serves as a binder for the cellulosic material. The dissolution of this binder serves to liberate the fibres, which are separated from the residual cooking liquor, which is known in the art as black liquor. The black liquor, which contains inorganic compounds resulting from the cooking chemical along with the dissolved wood components is first concentrated by evaporation and is then fed to a recovery furnace where organic wood components are burnt with the evolution of heat, while the inorganic components are subjected to a reduction stage in the furnace. The inorganic residue from the furnace is called smelt. The smelt derived from a kraft pulping process contains soda ash (sodium carbonate) and sodium sulfide.

Kraft recovery furnaces usually represent a substantial capital investment with fixed capacity. Accordingly, few viable options exist for pulping chemicals recovery for a kraft mill wishing to increase its volume of production where the recovery furnace is running at capacity.

It is therefore an object of the present invention to provide a process which permits an increase in the capacity for inorganics recovery for kraft furnaces which are already running at capacity.

BRIEF DESCRIPTION OF THE INVENTION

The present invention relates to a kraft overload recovery process for the recovery of black liquor (b.l.) resulting from a kraft pulping process in a kraft recovery system having a kraft recovery furnace comprising the steps of:

(a) feeding a first portion of the b.l. to said furnace, (b) acidifying a second portion of said b.l. with an acid comprising sulfuric acid so as to insolubilize substantially all the lignin contained in the second portion and form sodium sulfate, (c) separating the insoluble lignin from the rest of the acidified second portion, the rest of the acidified second portion comprising organic and inorganic components, (d) feeding at least said inorganic component, comprising the sodium sulfate to the kraft recovery system operating at capacity.

BRIEF DESCRIPTION OF THE DRAWINGS

The single figure (FIG. 1) provides a schematic flow diagram of the preferred embodiment of the present invention.

DETAILED DESCRIPTION OF THE PRESENT INVENTION

Figure 1:
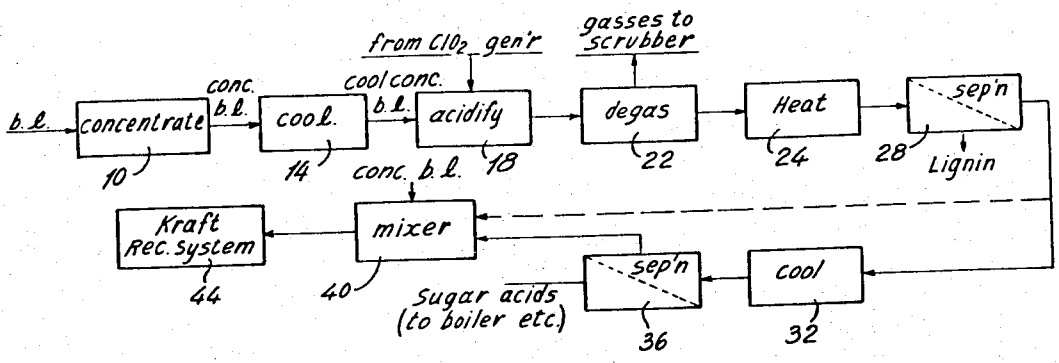

Accordingly, the present invention provides a process for treating black liquor which is a product of a kraft process for pulping lignocellulosic material. The process permits the recovery of lignin (and possibly sugar acids) and the recovery of inorganic values from the black liquor in excess of those recoverable by a fixed capacity kraft recovery system.

Broadly then, this process for augmenting the recovery capacity of a kraft recovery system already operating at capacity will comprise feeding a first portion of the b.l. to the kraft recovery system which is thus operating at capacity, acidifying a second portion of the b.l. with an acid containing sulfuric acid so as to insolubilize substantially all the lignin contained in the second portion and convert substantially all the sodium values therein to sodium sulfate. This insoluble lignin is then separated from the acidified second portion and at least the inorganic component of the second portion is fed to the kraft recovery system.

The black liquor (b.l.) resulting from a kraft pulping process usually has a pH in the range of about 11 to 13 (typically about 12) and contains sodium carbonate and sodium sulfate, sodium sulfide and sodium organic salts. Before further treatment of the b.l., the sulfide should be oxidized by blowing air through the liquor.

In a first embodiment, the concentrated b.l. which is usually at a solids concentration of at least about 40%, more typically about 50% solids is cooled to a temperature below about 50° C., preferably between about 5° and 40° C. This can be done by a conventional heat exchange means. The cooled and concentrated b.l. is mixed with a steam containing sulfuric acid, where the pH of the mixture is maintained at most about 5, preferably below about 4.5. The sulfuric acid-containing bath used in this step can be the effluent from a chlorine dioxide generator associated with the bleaching facility of the kraft mill (which comprises sodium sulfate and sulfuric acid) or it can be conventional industrial grade sulfuric acid. This reduction of the pH results in the insolubilization of the lignin, as well as the conversion of the sugar acid salts in the b.l. to the corresponding sugar acids as well as the substantial conversion of the sodium values to sodium sulfate. Similar conversions, such as sodium acetate to acetic acid, also occur during the acidification. The carbon dioxide and possibly some hydrogen sulfide which are formed during the acidification are removed during a degasification step, e.g. by the reduction of pressure above the b.l. The gases evolved during the degasification can be passed through a scrubber, fed to a furnace or the like.

The acidified and degassed liquor is then heated to temperature in excess of 60° C., preferably to about 90° C., possibly by the passage of steam or more preferably by the use of steam coils immersed in the b.l. The heating serves to coagulate (or fuse) the lignin which tends to float to the surface because of the gas entrapped therein during its fusion and the high density of the concentrated b.l. The coagulated lignin is easily separated from the rest of the b.l. by skimming the surface, or decantation of the b.l. The lignin so obtained can be subjected to further chemical treatment if so desired, or used as a fuel e.g. in a conventional boiler, fluidized beds and the like.

Following the separation of the fused lignin, before feeding the residual b.l. to the kraft recovery furnace, sodium hydroxide should be added to the remaining b.l. in order to neutralise the excess acid therein if the residual alkali in the b.l. to which it is added is insufficient for this purpose. Alternatively, this residual liquor containing the sodium sulfate (anhydrous) and organics (including sugar acid salts) is then cooled to about 0° C. employing forced cooling means, whereby the anhydrous sodium sulfate hydrates, absorbing substantial quantities of water of crystallization from the surrounding solution, with one mole of the anhydrous sodium sulfate absorbing ten moles of water. This process of hydration of the sodium sulfate to glaubers salt reduces the free water from the residual b.l., leaving behind the sugar acids which are liquid and can consequently, be separated e.g. by filtration, centrifugation etc. from the crystalline glaubers salt. The concentration of black liquor following the passage through the multiple effect evaporator, and the strength of the sulfuric acid should preferably be adjusted so as to ensure that the concentration of the anhydrous sodium sulfate in the residual liquor is such that the formation of glaubers salt will leave the organic acids and sugar acids substantially free of water.

The hydrated sodium sulfate can then be mixed with a conventional concentrated black liquor, e.g. in a turbulent mixer before this concentrated black liquor is fed to the recovery furnace. This eliminates the saltcake makeup required resulting from the loss of b.l. due to an overloaded recovery process. Since the inorganics added to the concentrated b.l. comprise essentially sodium sulfate, their reduction to a useable pulping chemical is easily accomplished in a kraft recovery furnace.

In a second embodiment of the present embodiment, the temperature of an unconcentrated black liquor from a kraft pulping process is first adjusted to about 57°–65° C., then it is acidified with an acid comprising sulfuric acid to a pH of below about 5, but preferably below about 4.5, so as to render insoluble the lignin contained therein and convert the sodium values therein to sodium sulfate. The acidified b.l. is maintained at a temperature in the range of about 57°–65° C. in order to agglomerate the lignin particles to a size that facilitates separation, e.g. without blinding, clogging or gumming up the filter. The agglomerated lignin is then separated from the rest of the b.l. e.g. by filtration, centrifugation, etc. Following the removal of the lignin, the rest of the b.l. can be neutralized to prevent loss of organic acid volatiles in the following concentration step. It is then concentrated reacidified and cooled so as to form crystals of glaubers salt which can be separated from the sugar acids, and/or the sugar acid salts before the salt cake is fed to the furnace as was described in the preceding embodiment. Alternatively, following the removal of the lignin the rest of the b.l. can be neutralized with sodium hydroxide or possibly by mixing with b.l. containing sufficient residual alkali before being fed to the recovery system.

Referring now to the single figure (FIG. 1), which illustrates the first embodiment of the present invention, we note that the b.l. is first concentrated in a multiple effect evaporator (10) to at least about 40% solids concentration (preferably about 50% solids). The concentrated b.l. is then cooled e.g. via heat exchange means (14) to a temperature at or below about 40° C. The cooled black liquor is added to an acid bath (18) where its pH reduced to below about 3.5. The sulfuric acid containing bath in this case is preferably obtained from the liquid effluent of a chlorine dioxide generator (which includes sodium sulfate therein). The carbon dioxide, and possibly some hydrogen sulfide which are evolved, are separated from the acidified liquid in the degassing stage (22) possibly sent to the scrubbers and then the degassed liquid is heated (24) to a temperature in excess of about 60° C., preferably by steam coils immersed in the liquid. The gas evolved here can be passed through a scrubber, sent to a furnace, etc. The insoluble lignin which is fused by this heating is separated in the following step (28) by decantation and the like. The decanted liquid is cooled to about 0° C. (by forced cooling means 30), the sodium sulfate permitted to hydrate scavenge substantially all the water, and the hydrated sodium sulfate (glauber salt) separated e.g. by filtration (36) from the residual organic and sugar acids. The sugar acids thus obtained can be used in any suitable manner, possibly being burnt in a conventional furnace. The hydrated sodium sulfate can be mixed with concentrated b.l. in a mixer (40) before being fed to the kraft recovery furnace (44). Alternatively, should the concentrated b.l. which is being fed to the kraft recovery furnace contain residual alkali sufficient to neutralize the decanted liquid, the acidic, decanted liquid can be directly neutralized in the mixer 40 (as shown by the dotted line in FIG. 1), by the concentrated b.l., bypassing the intermediate cooling and separation steps 32 and 36. Sodium sulfate will be obtained in a reduced form from the kraft furnace and is useable in further pulping of lignocellulosic material.

As will be evident from the foregoing this process effectively increases the inorganic recovery capacity of a kraft recovery furnace without capital costs of the magnitude that would be conventionally incurred. The capacity for recovery of the organics contained in the b.l. is also augmented, by the recovery of lignin for its chemical or fuel value; and/or by the possible recovery of the sugar acid components. The lignin and/or sugars may be burned in the normally available bark burning equipment or the like.

Modifications can be made to the foregoing without departing from the spirit of the invention as defined in the appended claims.

1. A Kraft overload recovery process for the recovery of black liquor resulting from a kraft pulping process in a kraft recovery system having a kraft recovery process comprising the steps of:

(a) feeding a first portion of said black liquor to said furnace, (b) adjusting the concentration of a second portion of said black liquor to a concentration of at least 40% solids, and acidifying said second portion of said black liquor with an acid comprising sulfuric acid so as to form at a temperature above 57° C. an insoluble coagulated layer of substantially all the lignin contained in said second portion on top of said second portion of black liquor and to form sodium sulfate, (c) separating said insoluble coagulated layer of lignin on the top of the rest of said acidified second portion, said rest of said acidified second portion comprising organic and inorganic components, (d) feeding at least said inorganic component comprising said sodium sulfate to said kraft recovery system operating at capacity.

2. A process as defined in claim 1, wherein said second portion is cooled to between about 5° and 50° C. before said acidifying.

3. A process as defined in claim 2 wherein said acidifying reduces the pH of said portion to at most 4.5.

4. A process as defined in claim 2, wherein the temperature of said acidified second portion is raised to at least about 60° C. before said separating of said insoluble lignin.

5. A process as defined in claims 2 or 4 wherein said lignin in separated from said rest of said second portion by decantation.

6. Process as defined in claims 2 or 4, wherein said rest of said second portion is cooled so as to hydrate and crystallize said sodium sulfate before said feeding of said inorganic component to said kraft recovery system.

7. Process as defined in claim 1, wherein said rest of said acidified second portion is neutralized before feeding said inorganic component to said kraft recovery system.

8. Process as defined in claim 7, wherein said neutralization of said acidified second portion is carried out by mixing said acidified, second portion with said first portion where said first portion contains sufficient alkali for said neutralization.

9. Process as defined in claim 7, wherein addition of sodium hydroxide to said acidified second portion results in said neutralization.

10. Process as defined in claim 1, where temperature of said second portion is adjusted to the range of about 57°-65° C. before said separating of said lignin.

11. A process as defined in claims 1 or 10, wherein said acidifying of said second portion is to a pH of at most 4.5.

12. Process as defined in claim 10, wherein said separating of said insoluble lignin is accomplished by one of decantation, filtration and centrifugation.

13. Process as defined in claim 10, wherein said rest of said acidified second portion is concentrated, and cooled so as to hydrate and crystallize said sodium sulfate before said feeding of said inorganic component to said Kraft recovering system.

14. Process as defined in claims 1, 2 or 10, wherein said separated lignin is fed to a boiler for recovery of its calorific value.

15. Process as defined in claims 1, 2 or 10, wherein said separated lignin is burnt in a fluidized bed.

16. Process as defined in claim 1, wherein said rest of said acidified second portion is neutralized before said inorganic component of said second portion is fed to said Kraft recovery furnace.

* * * * *